US008251470B2

(12) United States Patent
Bastardas et al.

(10) Patent No.: US 8,251,470 B2
(45) Date of Patent: Aug. 28, 2012

(54) DEVICE FOR USE WITH A CARRIAGE CARRYING A PRINTHEAD AND A SENSOR

(75) Inventors: Roger Bastardas, Sant Just Desvern (ES); Jordi Ferran, Cerdanycla del Valles (ES); Lluis Hierro, Sant Lloren Hortons (ES); Félix Ruiz, Sant Cugat del Valles Barcelona (ES); Laura Portela, Barbera del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 228 days.

(21) Appl. No.: 12/825,436

(22) Filed: Jun. 29, 2010

(65) Prior Publication Data

US 2011/0316929 A1 Dec. 29, 2011

(51) Int. Cl.
*B41J 25/308* (2006.01)

(52) U.S. Cl. ..... 347/8

(58) Field of Classification Search ..... None
See application file for complete search history.

(56) References Cited

U.S. PATENT DOCUMENTS

| | | | |
|---|---|---|---|
| 5,466,077 | A | 11/1995 | Movaghar et al. |
| 6,406,110 | B1 | 6/2002 | Ahne et al. |
| 6,629,787 | B2 | 10/2003 | Lee et al. |
| 6,666,537 | B1 | 12/2003 | Kelley et al. |
| 7,037,008 | B2 | 5/2006 | Ota |
| 7,083,245 | B2 | 8/2006 | Yamamoto |

*Primary Examiner* — Matthew Luu
*Assistant Examiner* — Justin Seo
(74) *Attorney, Agent, or Firm* — Garry A. Perry

(57) ABSTRACT

In one embodiment, a device for use with a first carriage carrying a printhead and a sensor includes a track. The track is positioned adjacent to a path, the path being followed by the first carriage. A second carriage is movable along the track and carries a target. The second carriage is movable between a first position, in which the target is away from the sensor, and a second position, in which the target is adjacent to the sensor and a reference included in the target is a known distance away from the sensor.

20 Claims, 7 Drawing Sheets

DEVICE FOR USE WITH A CARRIAGE CARRYING A PRINTHEAD AND A SENSOR

BACKGROUND

The present disclosure relates to printers that eject ink or other marking material onto a printable media. In many printer configurations print quality degrades as distance from a printhead to the printable media (sometimes referred to as the "pen to paper space" or "PPS") increases. It can be advantageous to ensure a specific distance between the printhead and the printable media that is small enough to assure high print quality, yet is large enough to avoid contact between the printhead and the printable media. Some printers include a sensor, carried by a carriage that also carries a printhead, the sensor configured to measure the distance from the printhead to the printable media.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

FIG. 5A illustrates a view of a first surface of the target, and FIG. 5B illustrates a view of a second surface of the target.

The same part numbers designate the same or similar parts throughout the figures.

DETAILED DESCRIPTION OF EMBODIMENTS

A manufacturing error in, or degradation of, the optics or electronics of a sensor can cause a PPS measurement that is made utilizing the sensor to be erroneous. Likewise, a manufacturing error in, or degradation of, carriage bushings or structural components that support a sensor-carrying carriage can cause an inaccurate distance measurement. Such inaccurate distance measurements may result in poor print quality and/or damage to the printer. For example, a faulty distance measurement that results in an excessive PPS can cause the printhead to eject ink or other marking material onto the printable media in a suboptimal pattern. In another example, a faulty distance measurement that results in an inadequate PPS can cause contact between the printhead and the printable media that damages the media and/or the printhead. Embodiments of the present disclosure were developed to provide a device to be utilized with a carriage that carries a printhead and a sensor, the sensor to measure distance. The device may be utilized in calculating a compensation factor that may be applied to distance measurements made by the sensor, to assure quality printing.

Figure 1:
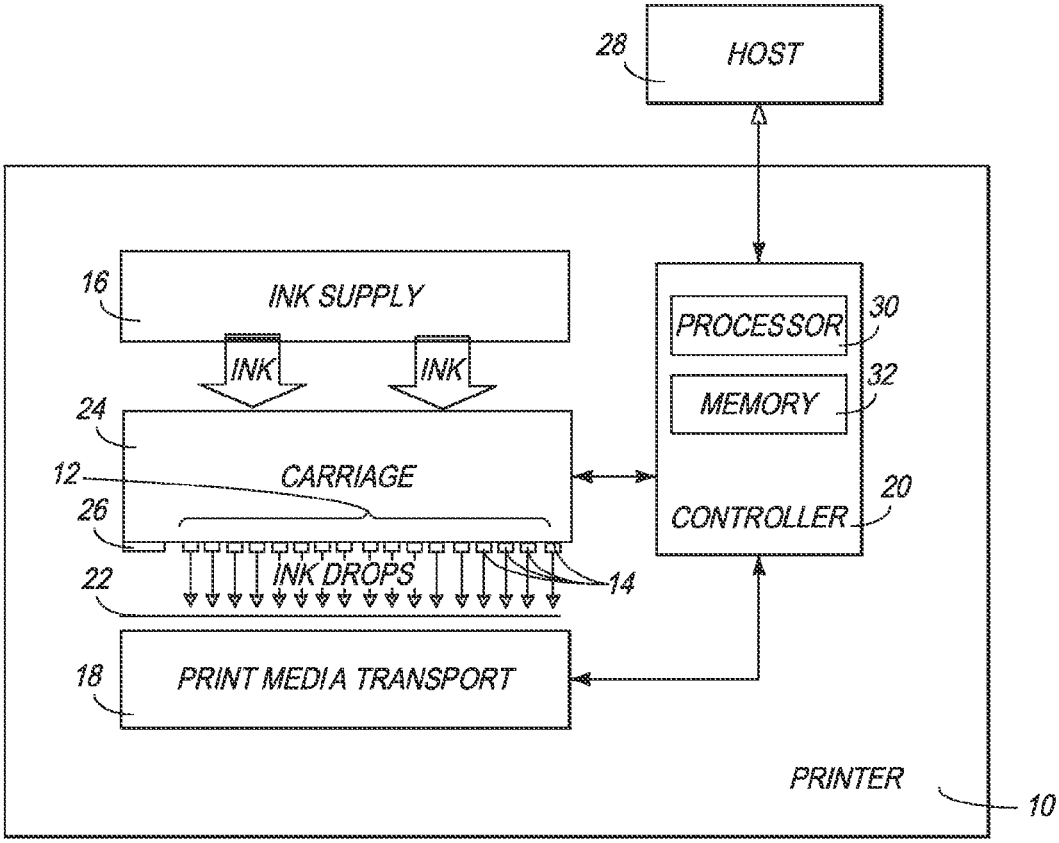
FIG. 1 is a block diagram illustrating one embodiment of a printer.

FIG. 1 is a block diagram illustrating a printer 10 that includes an array 12 of printheads 14, an ink supply 16, a media transport system 18 and an electronic printer controller 20. Printer 10 illustrates one example of an environment for implementing embodiments of the new device for use with a carriage carrying a printhead and a sensor. Printhead array 12 in FIG. 1 represents generally one or more printheads 14 and the associated mechanical and electrical components for ejecting drops of ink or other marking material on to a sheet or continuous web of paper or other printable media 22. As used in this specification and the appended claims, "printable media" and "media" are used synonymously. In operation, printer controller 20 selectively energizes the ink ejector elements in a printhead, or group of printheads, in the appropriate sequence to eject ink or other marking material on to media 22 in a pattern corresponding to the desired printed image. In embodiments the printheads 14 may be drop-on-demand inkjet printheads, thermo resistive printheads, piezo printheads or resistive printheads.

Printhead array 12 and ink supply 16 may be housed together as a single unit or they may comprise separate units. Printhead array 12 may be in the form of a unit that is scanned back and forth across the width of media 22 on a moveable carriage 24. The carriage 24 may also carry a sensor 26, the sensor 26 to measure a distance PPS. In an embodiment, the sensor 26 may be an optical sensor, an acoustic sensor or another type of distance measurement sensor. Media transport system 18 advances media 22 lengthwise past printhead array 12. Media transport 18 may advance media 22 incrementally past array 12, stopping as each swath is printed and then advancing media 22 for printing the next swath.

Controller 20 may receive print data from a computer or other host device 28 and, when necessary, process that data into printer control information and image data. Controller 20 controls the movement of the operative components of media transport system 18. And, as noted above, controller 20 is electrically connected to printhead array 12 to energize the printhead ejector elements to eject ink drops or other marking materials on to media 22. By coordinating the relative position of array 12 and media 22 with the ejection of ink drops or other marking material, controller 20 produces the desired image on media 22 according to the print data received from host device 28. The controller 20 may include a processor 30 and a memory 32.

Figure 2A:
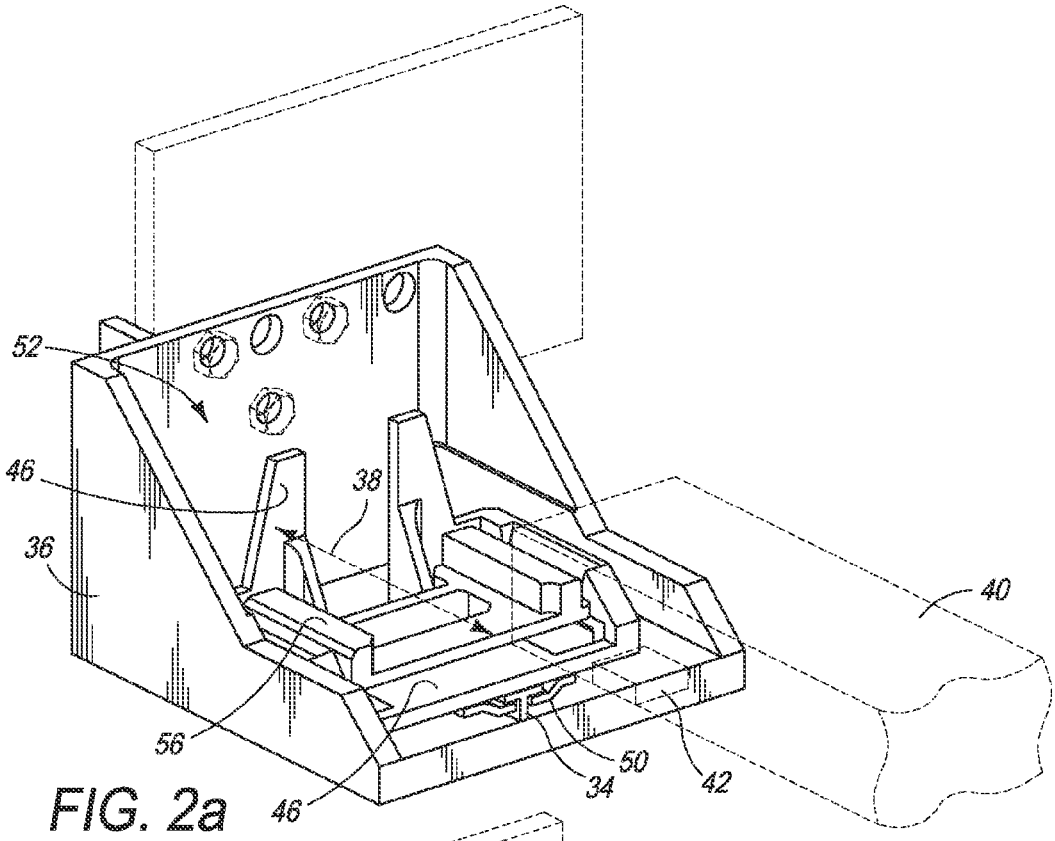
FIGS. 2A and 2B are perspective views illustrating one embodiment of a device for use with a first carriage carrying a printhead and a sensor. The device is shown with a second carriage in a first position in FIG. 2A, and with the second carriage in a second position in FIG. 2B.
Figure 2B:
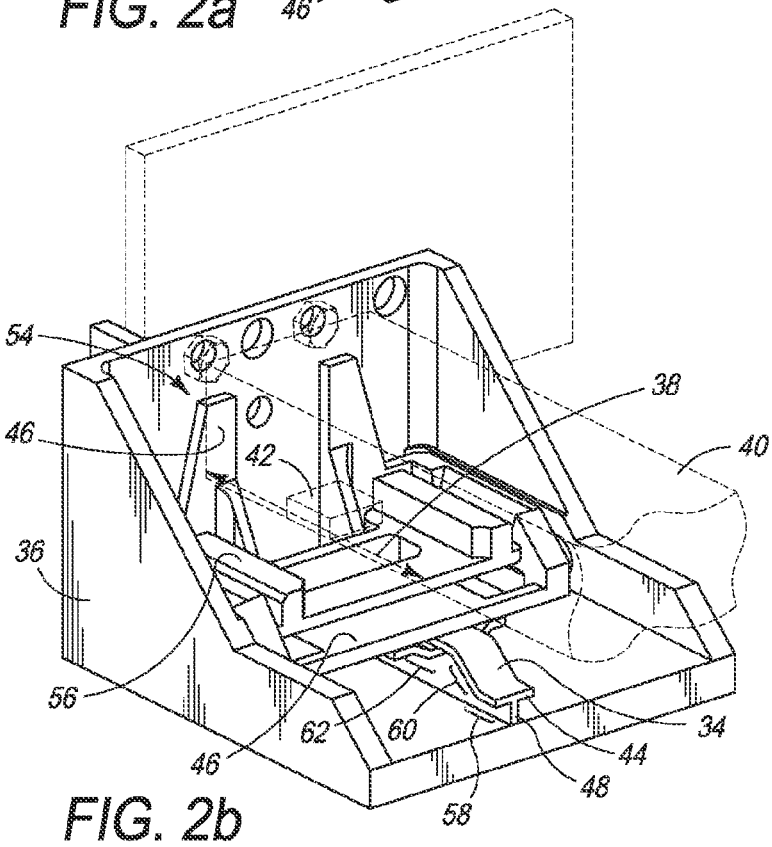

FIGS. 2A and 2B are perspective views illustrating one embodiment of a device for use within a printer that includes a carriage carrying a printhead and a sensor, such as printer 10 shown in FIG. 1. The device is shown with a second carriage in a first position in FIG. 2A, and with the second carriage in a second position in FIG. 2B.

Referring first to FIG. 2A, in an embodiment a track 34 attaches to, or is included as a part of, a base 36. As used in this specification and the appended claims, a "track" is an element, member, or structure upon which something travels or moves, including but not limited to a rail. In an embodiment, the track 34 and base 36 are constructed of a plastic or other polymer. The track 34 is positioned adjacent to a path 38 that is followed by a first carriage 40, the first carriage 40 carrying a printhead 110 (FIG. 7A) and a sensor 42. In an embodiment the first carriage 40 may carry a plurality of printheads. As used in this specification and the appended claims, a "path" is a line or route along which something travels or moves. In an embodiment, the sensor 42 is an optical sensor configured to measure a distance from a printhead to a media or other target. In an embodiment, the track 34 is situated such that the length of the track 34 is parallel to the path 38.

In an embodiment, the track 34 is configured in a "T" shape when viewed in cross-section, with the "T" shape extending the length of the track. A second carriage 46 movably connects to a horizontal portion 44 (FIG. 2B) of the track 34. In this embodiment, a vertical portion 48 (FIG. 2B) of the track is affixed to the base 36. In an embodiment, a tension apparatus 50, which may be in the form of a spring, connects to the second carriage 46 and movably connects to the track 34 to maintain contact between the second carriage 46 and the track 34.

Moving to FIG. 2B, the track 34 is sloped to guide the second carriage 46, towards the sensor 42, in this example upward, as the second carriage 46 moves along the track 34 from a first position 52 (FIG. 2A) to a second position 54 (FIG. 2B). In an embodiment, the second carriage 46 is movable from the first position 52 (FIG. 2A) to the second position 54 at the urging of the first carriage 40. When the second carriage 46 is in the first position 52 (FIG. 2A), a target 56 that is carried by the second carriage 46 is positioned away from a sensor 42. When the second carriage 46 is in the second position 54 the target 56 is positioned adjacent to the sensor 42, and a reference 74 (FIG. 4) included in the target 56 is a known distance away from the sensor 42. In an embodiment, the target 56 is configured to contact the sensor 42 when the second carriage 46 is in the second position 54.

In an embodiment, the track 34 includes a first portion 58 with no slope, a second portion 60 with a slope, the second portion 60 connecting to the first portion 58, and a third portion 62 with no slope and that connects to the second portion 60 and is closer to the path 38 than the first portion 58. In this embodiment, when the second carriage 46 is in the first position 52 (FIG. 2A), the second carriage is in contact with the first portion 58. In this embodiment, when the second carriage 46 is in the second position 54, the second carriage 46 is in contact with the third portion 62.

Figure 3A:
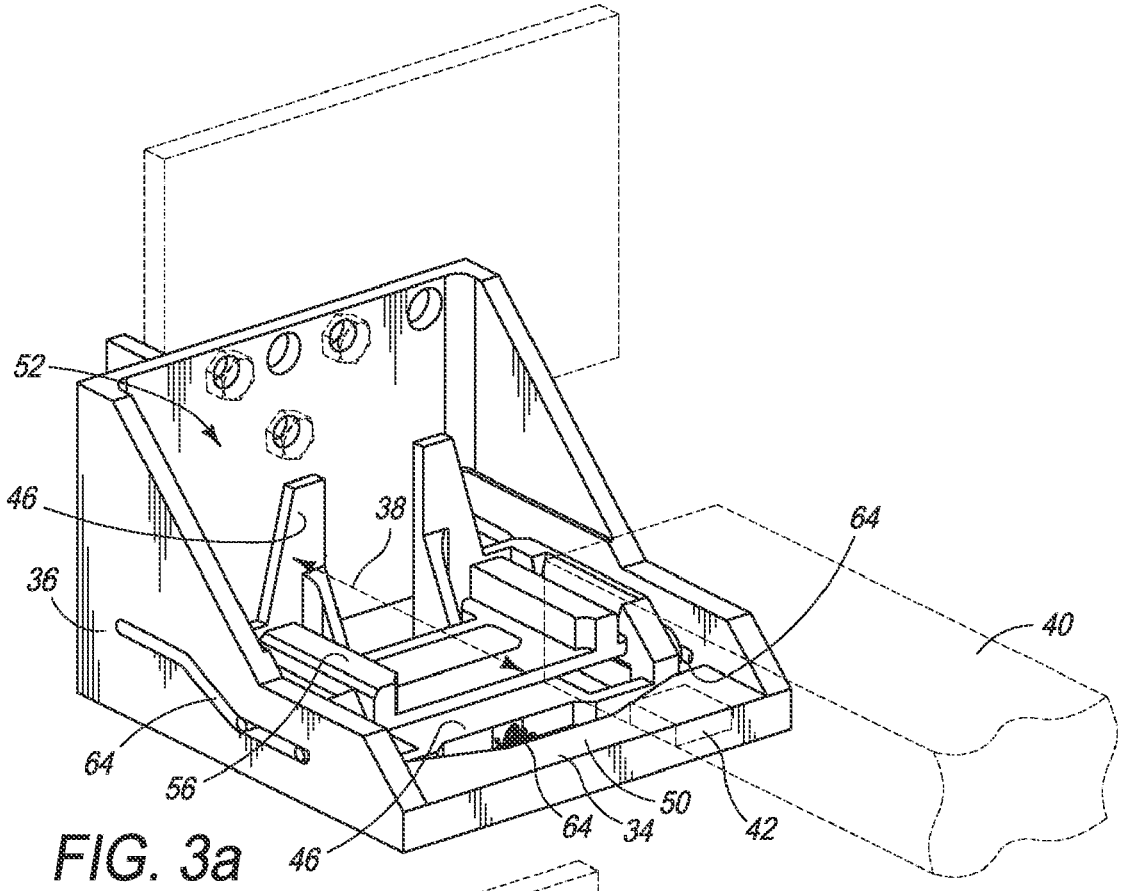
FIGS. 3A and 3B are perspective views illustrating an embodiment of a device for use with a first carriage carrying a printhead and a sensor. The device is shown with a second carriage in a first position in FIG. 3A, and with the second carriage in a second position in FIG. 3B.
Figure 3B:
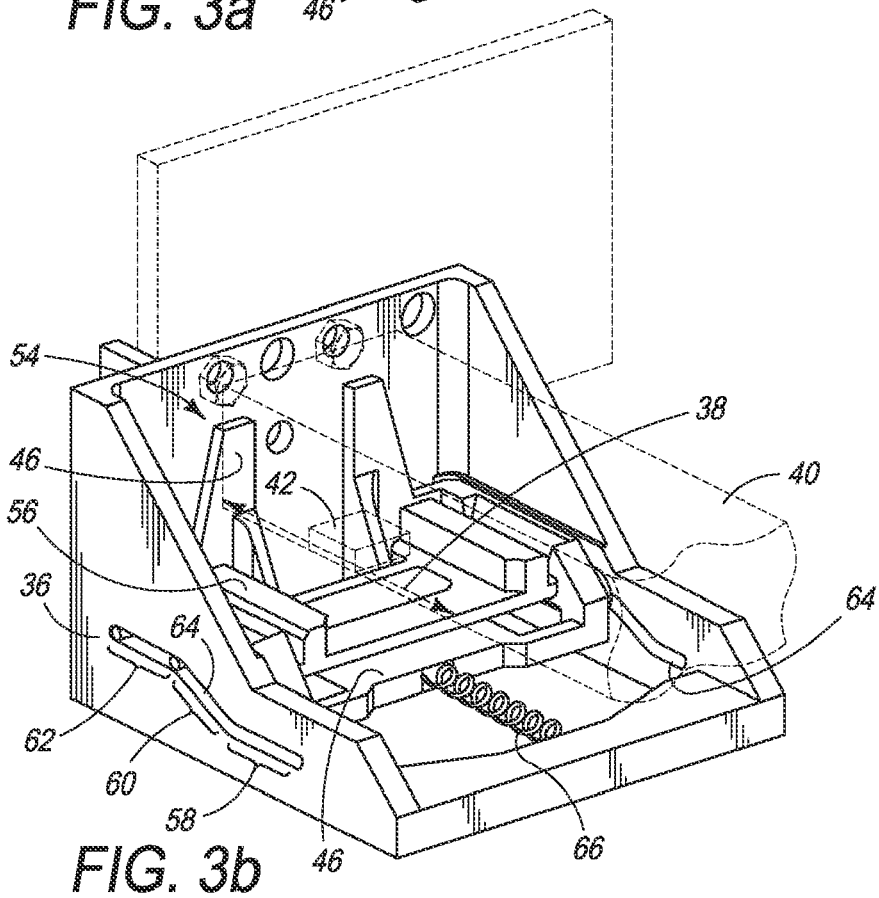

FIGS. 3A and 3B are perspective views illustrating an embodiment of a device for use within a printer that includes a carriage carrying a printhead and a sensor, such as printer 10 shown in FIG. 1. The device is shown with a second carriage in a first position in FIG. 3A, and with a second carriage in a second position in FIG. 3B.

Referring first to FIG. 3A, in an embodiment a base 36 includes a pair of tracks 64 spaced apart from one another. In an embodiment the base 36 and the pair of tracks 64 are positioned adjacent to a path 38 that is followed by a first carriage 40, the first carriage 40 carrying a printhead 110 (FIG. 7A) and a sensor 42. In an embodiment, the sensor 42 may be an acoustic sensor configured to measure a distance from the printhead 110 (FIG. 7A) to a media or other target.

Figure 4:
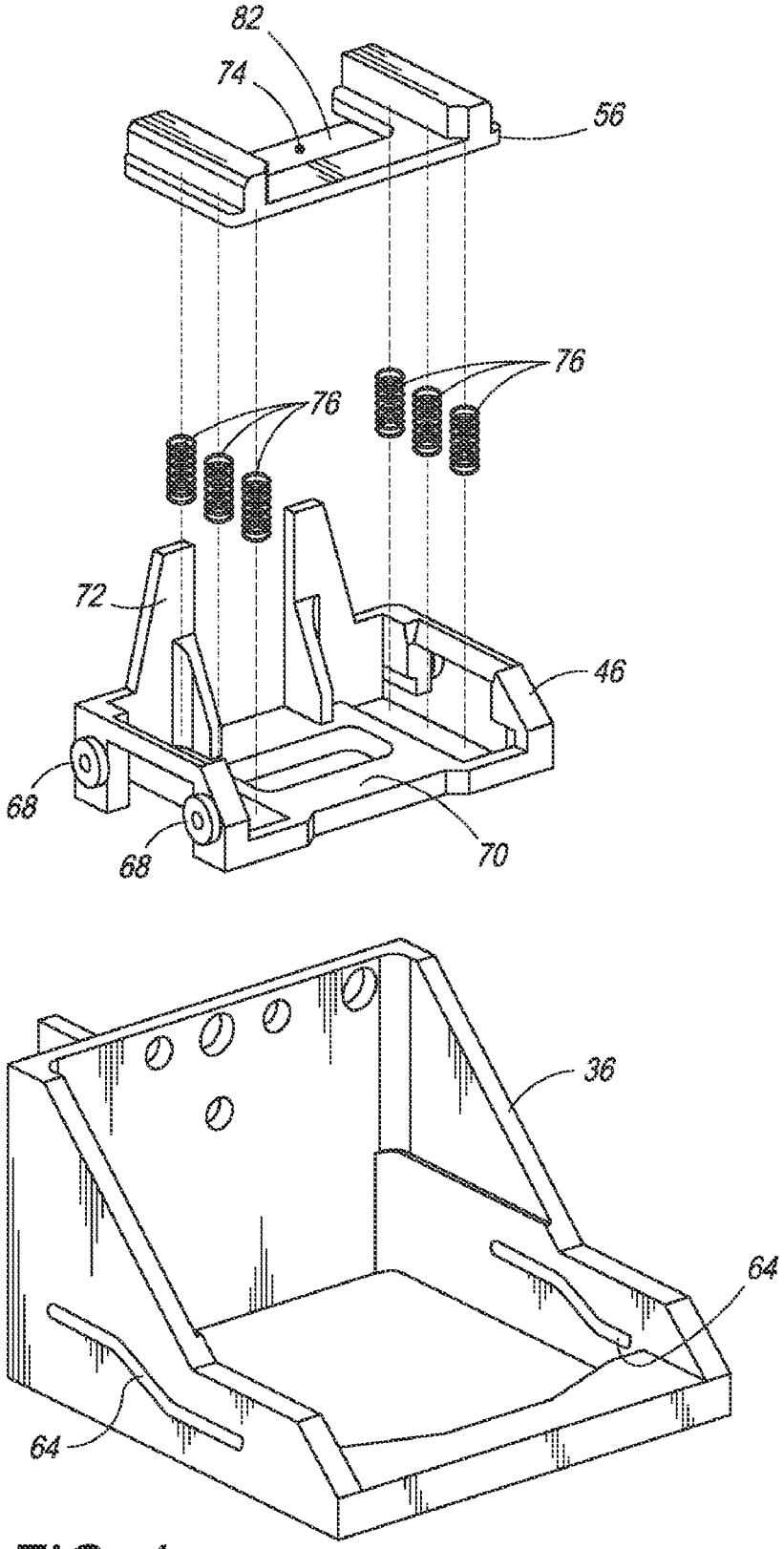
FIG. 4 is an exploded, generally perspective, view of the device shown in shown in FIGS. 3A and 3B.

The pair of tracks 64 is configured such that a second carriage 46 is supported by, and movable along, the pair of tracks 64 simultaneously. In an embodiment, the pair of tracks 64 comprises cut-out areas within the base 36, the base being constructed of a plastic or other polymeric material. In an embodiment, the pair of tracks 64 comprises a pair of channels within the base 36 for the second carriage 46 to follow, formed during molding of the base. In an embodiment, the pair of tracks 64 comprises a pair of rails affixed to the base 36. The second carriage 46 carries a target 56, the target 56 including a reference 74 (FIG. 4). In a first position 52, the target 56 is positioned away from a sensor 42.

Moving to FIG. 3B, in the second position 54, the target 56 is positioned adjacent to the sensor 42, and a reference 74 (FIG. 4) included in the target 56 is a known distance away from the sensor 42. In an embodiment, the second carriage 46 is movable from the first position 52 (FIG. 3A) to the second position 54 at the urging of the first carriage 40.

Each of the tracks comprised within the pair of tracks 64 is sloped to guide the second carriage 46 towards the sensor 42 as the second carriage 46 moves from the first position 52 (FIG. 3A) to the second position 54. In an embodiment, each of the pair of tracks 64 includes a first portion 58 with no slope, a second portion 60 with a slope, the second portion 60 connecting to the first portion 58, and a third portion 62 with no slope, the third portion connecting to the second portion 60 and closer to the path 38 than the first portion 58. In this embodiment, when the second carriage 46 is in the first position 52 (FIG. 3A), the second carriage 46 is in contact with the first portions 58. In this embodiment, when the second carriage 46 is in the second position 54, the second carriage 46 is in contact with the third portions 62.

In an embodiment, a biasing device 66 attaches to the second carriage 46 and the base 36, to bias the second carriage 46 to the first position 52. In an embodiment the biasing device 66 comprises a tension spring. In an embodiment the biasing device 66 comprises a compression spring. In an embodiment, the biasing device 66 connects to printer structure other than the base 36.

FIG. 4 is an exploded, generally perspective, view of the device shown in shown in FIGS. 3A and 3B. In an embodiment a base 36 includes a pair of tracks 64 spaced apart from one another, configured such that a second carriage 46 is supported by, and movable along, the pair of tracks 64 simultaneously. In an embodiment, base includes a plastic or other polymeric material, and the pair of tracks 64 comprises a pair of channels within the base 36. In an embodiment, the pair of tracks 64 comprises a pair of rails affixed to the base 36.

A second carriage 46 is configured to travel along the pair of tracks 64 simultaneously. In an embodiment, the second carriage 46 includes rollers 68 or sliding pads to facilitate movement of the second carriage 46 along the pair of tracks 64. The second carriage 46 carries a target 56. In an embodiment, the second carriage includes a first surface 70 to hold the target 56, and a second surface 72 to be engaged by a first carriage that holds a printhead and a sensor.

Target 56 that is carried by second carriage 46 includes a reference 74. In a first position 52, the target 56 is positioned away from a sensor 42. In this embodiment the reference 74 is located at the bottom of a recessed portion 82 of the target 56. In an embodiment, the reference 74 may comprise a recessed portion or a recessed surface within the target 56. In embodiments, the reference 74 may be attached to the target 56, or may be a part or portion of the target 56.

In an embodiment, a compressible member 76 is positioned between the second carriage 46 and the target 56, the compressible member 76 configured to promote contact between the target 56 and the sensor 42 when the second carriage 46 is in a second position 54 (FIG. 3B). In an embodiment, a plurality of compressible members 76 are positioned between the second carriage 46 and the target 56.

Figure 5A:
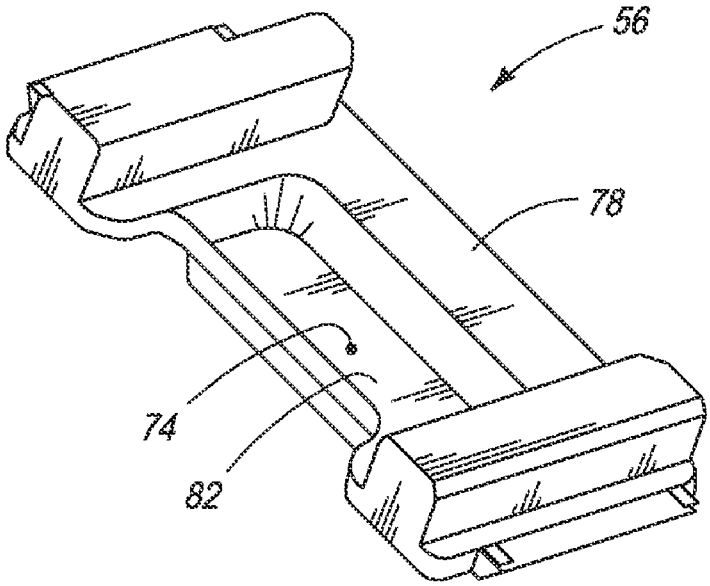
FIGS. 5A and 5B are more detailed perspective views of a target that is shown in FIG. 4.
Figure 5B:
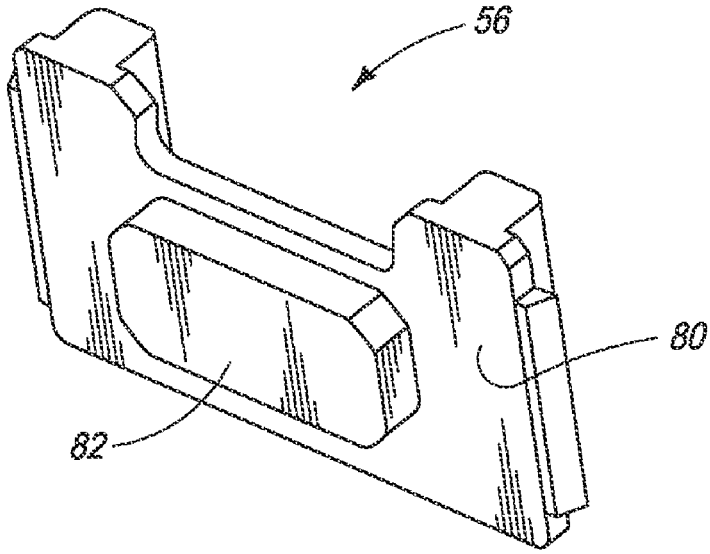

FIGS. 5A and 5B are more detailed perspective views of the embodiment of a target that is shown in FIG. 4. FIG. 5A illustrates a view of a first surface 78 of the target 56, and FIG. 5B illustrates a view of a second surface 80 of the target 56. The first surface 78 is configured to contact the sensor 42 (FIG. 3B) when the second carriage 46 (FIG. 3B) is in the second position 54 (FIG. 3B). The target 56 includes a reference 74, the reference 74 to provide a datum for a sensor 42 to aim to that is a known distance away from the sensor 42 (FIG. 3B). In this embodiment the reference 74 comprises the bottom of a recessed portion 82 of the target 56. In an embodiment, the reference 74 comprises a marking on the target. In an embodiment, the reference 74 is a datum affixed to the target. FIG. 5B illustrates a view of a second surface 80 of the target 56, that shows detail of the recessed portion 82 that is not visible in FIG. 5A.

Figure 6A:
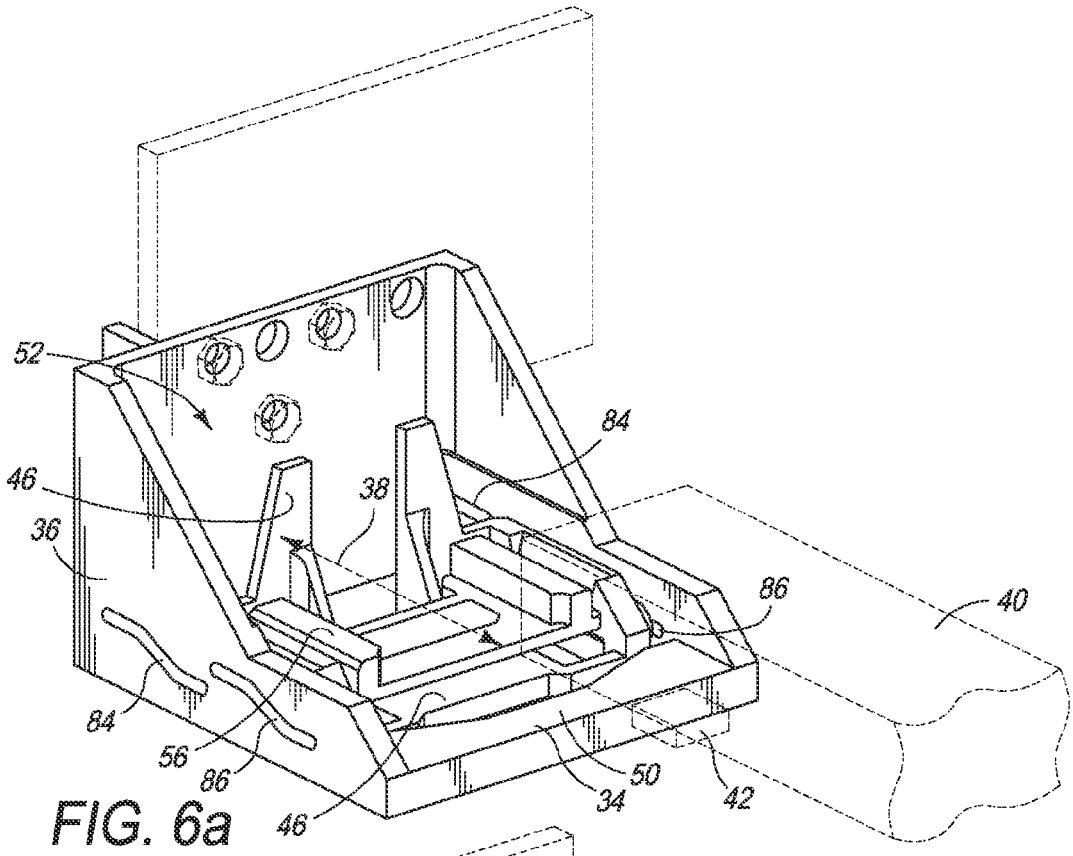
FIGS. 6A and 6B are perspective views illustrating an embodiment of a device for use with a first carriage carrying a printhead and a sensor. The device is shown with a second carriage in a first position in FIG. 6A, and with the second carriage in a second position in FIG. 6B.
Figure 6B:
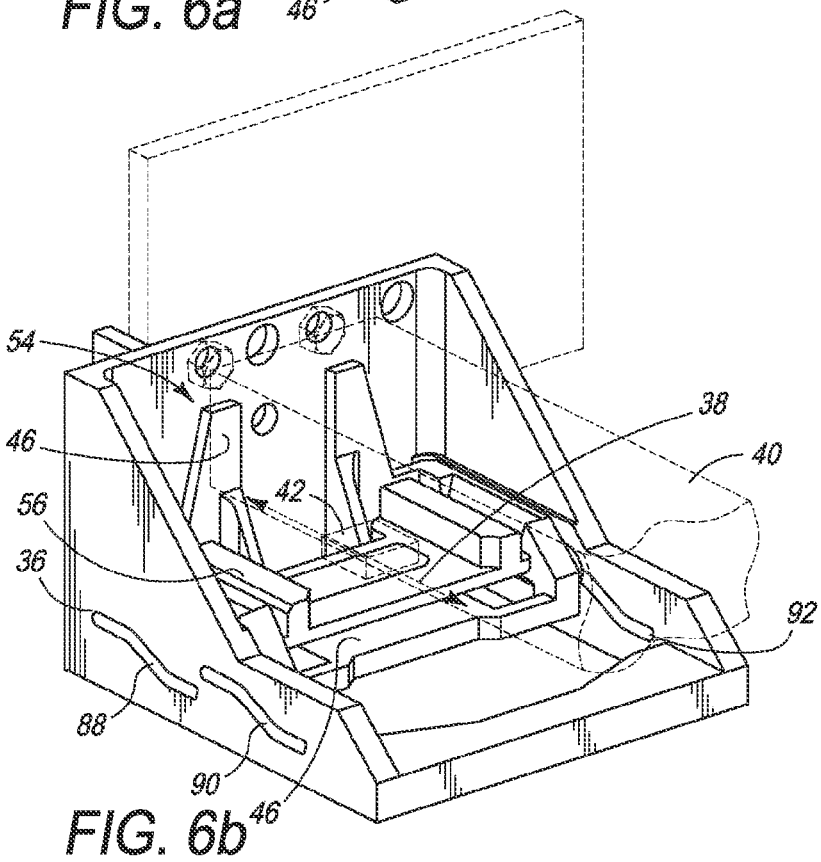

FIGS. 6A and 6B are perspective views illustrating an embodiment of a device for use within a printer that includes a carriage carrying a printhead and a sensor, such as printer 10 shown in FIG. 1. The device is shown with a second carriage in a first position in FIG. 6A, and with the second carriage in a second position in FIG. 6B.

Referring first to FIG. 6A, in an embodiment a base 36 includes a first pair of tracks 84 that are spaced apart from one another, and a second pair of tracks 86 that are spaced apart from one another. The first and second pairs of tracks are positioned adjacent to a path 38 that is followed by a first carriage 40, the first carriage 40 carrying a printhead 110 (FIG. 7A) and a sensor 42. In an embodiment, the sensor 42 is an LED sensor. In an embodiment, the first pair of tracks 84 and the second pair of tracks 86 comprise channels within the base 36 for the second carriage 46 to follow. In an embodiment, the first pair of tracks 84 and the second pair of tracks 86 comprise rails that attach to the base 36.

Each of the tracks comprised within the first pair of tracks 84 and the second pair of tracks 86 is sloped to guide a second carriage 46 that carries a target 56. The tracks are configured to guide the second carriage 46 from a first position 52 in which the target 56 does not touch the sensor 42 to a second position 54 (FIG. 6B) in which the target 56 contacts the sensor 42 to establish a known distance between the sensor 42 and a reference 74 (FIG. 4) included in the target 56. In an embodiment, the second carriage 46 is movable from the first position 52 to the second position 54 (FIG. 6B) at the urging of the first carriage 40.

Moving to FIG. 6B, the carriage 46 is shown in the second position 54, and the target 56 is in contact with the sensor 42. The reference 74 (FIG. 4) that is included in the target 56 is a known distance away from the sensor 42.

In an embodiment, a first track 88 that is comprised within the first pair of tracks 84 (FIG. 6A) and a second track 90 that is comprised within the second pair of tracks 86 (FIG. 6A) are substantially aligned along a first plane, the first plane parallel to the path 38. A third track (not visible in FIG. 6A or 6B) that is comprised within the first pair of tracks 84 (FIG. 6A) and a fourth track 92 that is comprised within the second pair of tracks 86 (FIG. 6A) are substantially aligned along a second plane, the second plane parallel to the first plane. The second carriage 46 is movable along the first track 88, second track 90, third track and fourth track 92 simultaneously.

Figure 7A:
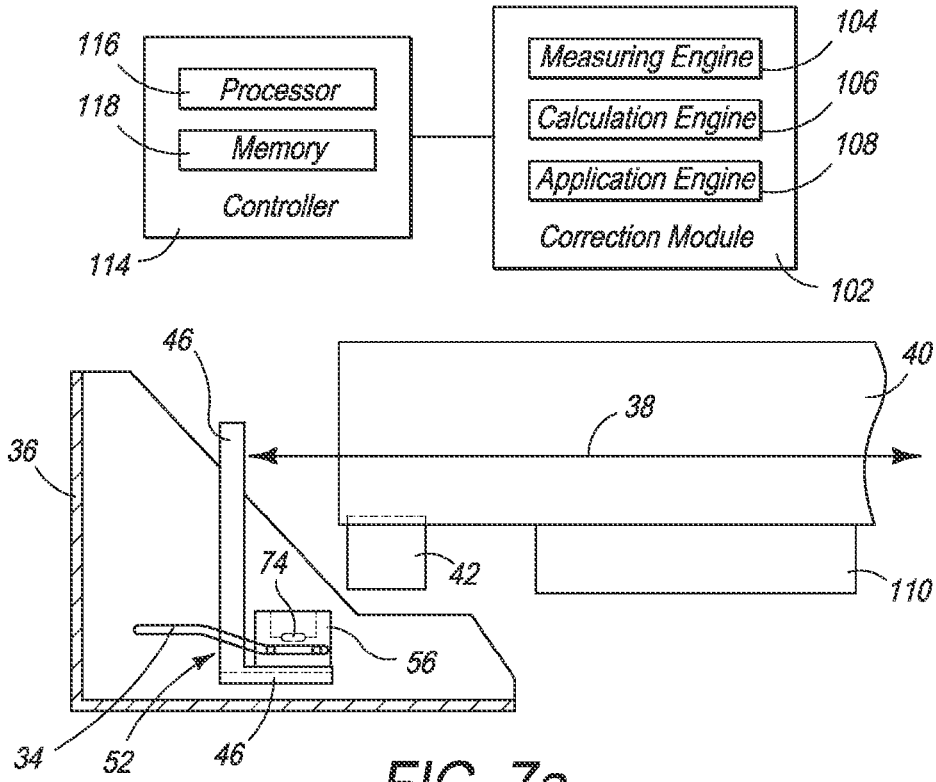
FIGS. 7A and 7B are side views of a device for use with a first carriage carrying a printhead and a sensor. The device is shown with a second carriage is in a first position in FIG. 7A, prior to being engaged by a first carriage. The device is shown with the second carriage in a second position in FIG. 7B, the second carriage having been urged by the first carriage.
Figure 7B:
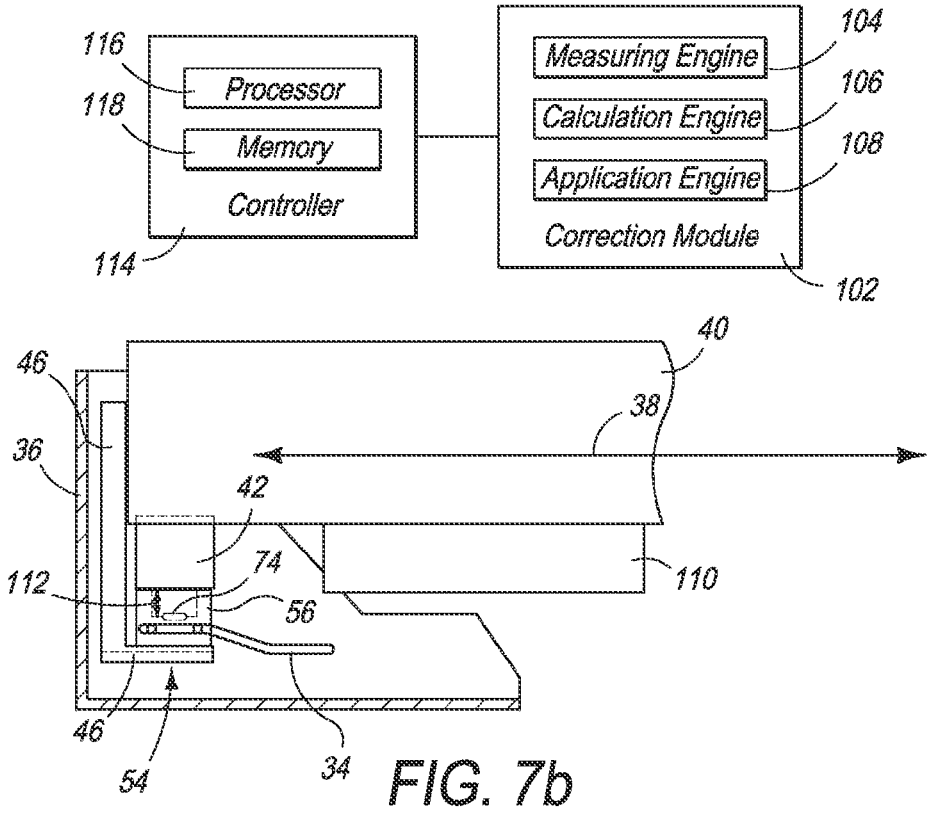

FIGS. 7A and 7B are side views of embodiments of a device and a correction module for use within a printer that includes a carriage carrying a printhead and a sensor, such as printer 10 shown in FIG. 1 The device is shown in a first position in FIG. 7A, and in a second position in FIG. 7B.

Referring first to FIG. 7A, in an embodiment a track 34 is positioned adjacent to a path 38 that is followed by a first carriage 40, the first carriage 40 carrying a printhead 110 and a sensor 42. In an embodiment, the sensor 42 is an optical sensor configured to measure a distance from the printhead 110 to a media or other target. In embodiments, a pair of tracks, or two or more pairs of tracks, may be utilized. The track 34 is configured such that a second carriage 46 is supported by, and movable along, the track 34 simultaneously. The second carriage 46 carries a target 56, the target 56 including a reference 74 (FIG. 4). The track 34 is sloped to guide the second carriage 46 towards the sensor 42 as the second carriage 46 moves from a first position 52 to a second position 54 (FIG. 7B). The target 56 is positioned away from sensor 42 when the second carriage 46 is in the first position 52.

Moving to FIG. 7B, in an embodiment, the second carriage 46 is movable from the first position 52 (FIG. 7A) to the second position 54 at the urging of the first carriage 40. The target 56 is positioned adjacent to the sensor 42, and a reference 74 (FIG. 4) included in the target 56 is a known distance away from the sensor 42, when the second carriage 46 is in the second position 54. In an embodiment, the target 56 is configured to contact the sensor 42 when the second carriage 46 is in the second position 54.

In an embodiment, the printer includes a correction module 102 and a controller 114. Correction module 102 represents generally any combination of hardware and programming configured for use in determining and applying a compensation factor to be applied to distance to media measurements made utilizing the sensor 42. In the examples of FIGS. 7A and 7B, correction module 102 is shown to include a measuring engine 104, a calculation engine 106, and an application engine 108. Measuring engine 104 represents generally any combination of hardware and programming configured to cause the sensor 42 to measure a first distance 112 to the reference 74. Calculation engine 106 represents generally any combination of hardware and programming configured to calculate a compensation factor that is a function of a ratio of the first distance 112 (FIG. 7B) and a second distance that is the known distance between the sensor 42 and the reference 74. In an embodiment, the calculation engine 106 is configured recalculate a compensation factor at a plurality of times without user intervention. Application engine 108 represents generally any combination of hardware and programming configured to apply the compensation factor to a measurement of a third distance made by the sensor, the third distance comprising a distance from the printhead 110 to a printable media. Controller 114 represents generally any combination of elements capable of executing or coordinating the operation of correction module 102. The controller 114 may include a processor 116 and a memory 118. The processor 116 may represent multiple processors, and the memory 118 may represent multiple memories. In an embodiment, the controller 114 may include a number of software components that are stored in a computer-readable medium, such as memory 118, and are executable by processor 116. In this respect, the term "executable" includes a program file that is in a form that can be directly (e.g. machine code) or indirectly (e.g. source code that is to be compiled) performed by the processor 116. An executable program may be stored in any portion or component of memory 118.

Various components illustrated in FIGS. 7A and 7B are defined at least in part as programs. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Also, the present disclosure may be embodied in part in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A device for use with a printer having a first carriage carrying a printhead and a sensor, comprising:

a track positioned adjacent to a path, the path being followed by the first carriage;

a second carriage movable along the track; and a target carried by the second carriage, the second carriage movable between a first position in which the target is away from the sensor and a second position in which the target is adjacent to the sensor and a reference included in the target is a known distance away from the sensor.

2. The device of claim 1, wherein the second carriage is movable from the first position to the second position at the urging of the first carriage.

3. The device of claim 1, wherein the track is sloped to guide the second carriage towards the sensor as the second carriage moves from the first position to the second position.

4. The device of claim 1, wherein the target is configured to contact the sensor when the second carriage is in the second position.

5. The device of claim 1, further comprising a compressible member positioned between the second carriage and the target, configured to promote contact between the target and the sensor when the second carriage is in the second position.

6. The device of claim 1, further comprising a biasing device that attaches to the second carriage and biases the second carriage to the first position.

7. The device of claim 1, wherein a length of the track is parallel to the path.

8. The device of claim 1, wherein the track comprises a first pair of tracks spaced apart from one another; and wherein the second carriage is movable along the first pair of tracks simultaneously.

9. The device of claim 8, wherein the track additionally comprises a second pair of tracks spaced apart from one another, and wherein the second carriage is movable along the first and second pairs of tracks simultaneously.

10. The device of claim 9, wherein a first track that is comprised within the first pair and a second track that is comprised within the second pair are substantially aligned along a first plane, and wherein a third track that is comprised within the first pair and a fourth track that is comprised within the second pair are substantially aligned along a second plane, the second plane parallel to the first plane.

11. A printer, comprising:

a print engine for printing on a printable media;

a printhead, a sensor to measure a distance, and a first carriage carrying the printhead and the sensor, the first carriage to travel along a path;

a track positioned adjoining the path;

a second carriage movable along the track; and a target including a reference, the target carried by the second carriage, the second carriage movable between a first position in which the target does not touch the sensor, and a second position in which the target contacts the sensor to establish a known distance between the sensor and the reference.

12. The printer of claim 11, wherein the second carriage is movable from the first position to the second position at the urging of the first carriage.

13. The printer of claim 11, wherein the track is sloped to guide the second carriage towards the sensor as the second carriage moves from the first position to the second position.

14. The printer of claim 11, further comprising a compressible member positioned between the second carriage and the target, to promote contact between the target and the sensor when the second carriage is in the second position.

15. The printer of claim 11, further comprising a biasing device that attaches to the second carriage to bias the second carriage towards the first position.

16. The printer of claim 11, wherein the track comprises a first pair of tracks spaced apart from one another; and wherein the second carriage is movable along the first pair of tracks simultaneously.

17. The printer of claim 16, wherein the track additionally comprises a second pair of tracks spaced apart from one another, and wherein the second carriage is movable along the first and second pairs of tracks simultaneously.

18. The printer of claim 11, further comprising a correction engine, configured to:

cause the sensor to measure a first distance to the reference;

calculate a compensation factor that is a function of a ratio of the first distance and a second distance that is the known distance; and apply the compensation factor to a measurement of a third distance made by the sensor, the third distance comprising a distance to the printable media.

19. The printer of claim 18, wherein the correction engine is additionally configured recalculate the compensation factor at a plurality of times without user intervention.

20. A device, comprising:

a first pair of tracks spaced apart from one another, the tracks positioned adjacent to a path and intersecting the path, the path being followed by a first carriage, the first carriage carrying a sensor and a printhead;

a second pair of tracks spaced apart from one another and positioned adjacent to the path;

a second carriage movable along the first and second pairs of tracks simultaneously from a first position to a second position at the urging of the first carriage, the first and second pairs of tracks having slopes to guide the second carriage towards the sensor;

a target carried by the second carriage, the second carriage positioning the target away from the sensor when in the first position, and the second carriage positioning the target to contact the sensor and establish a known distance from a reference on the target to the sensor when in the second position;

a compressible member positioned between the second carriage and the target to promote contact between the target and the sensor when the second carriage is in the second position; and a biasing device that attaches to the second carriage to bias the second carriage towards the first position.

* * * * *